United States Patent [19]

Singer

[11] 4,416,431

[45] Nov. 22, 1983

[54] YARN TENSIONING DEVICE

[76] Inventor: Hans S. Singer, 191 Inglewood, Greenville, S.C. 29615

[21] Appl. No.: 279,843

[22] Filed: Jul. 2, 1981

[51] Int. Cl.[3] ..... B65H 59/22; B65H 59/26

[52] U.S. Cl. ..... 242/151

[58] Field of Search ..... 242/151, 152, 149, 147 R, 242/153, 154, 152.1

[56] References Cited

U.S. PATENT DOCUMENTS

| | | | |
|---|---|---|---|
| 1,211,862 | 1/1917 | Lister | 242/152.1 |
| 1,437,997 | 12/1922 | Sawtell | 242/152.1 |
| 1,618,699 | 2/1927 | Davis | 242/151 |
| 4,095,757 | 6/1978 | Singer | 242/151 |
| 4,165,056 | 8/1979 | Singer | 242/151 |

FOREIGN PATENT DOCUMENTS

| | | | |
|---|---|---|---|
| 126805 | 5/1919 | United Kingdom | 242/151 |

*Primary Examiner*—Stanley N. Gilreath
*Attorney, Agent, or Firm*—Bailey & Hardaway

[57] ABSTRACT

A yarn tensioning device is illustrated having means for insuring proper threading of the yarn which may be accomplished manually assuring positioning of the yarn in the yarn channel or passageway beneath a number of stacked rollers.

2 Claims, 2 Drawing Figures

YARN TENSIONING DEVICE

BACKGROUND OF THE INVENTION

This is an improvement upon the invention of application Ser. No. 116,572, filed Jan. 29, 1980 for STRAND TENSIONING APPARATUS, the contents whereof are incorporated herein by reference. This invention hereof is also an improvement upon the yarn tensions illustrated in U.S. Pat. Nos. 4,095,757, issued June 20, 1978 and 4,165,056, issued Aug. 21, 1979 wherein rows of stacked cylinders are placed across the yarn path in vertical receptacles for adjustably controlling yarn tension.

While the tensioning device of the aforesaid application and patents is satisfactory in most respects, a problem may be encountered during threading if the operator does not take sufficient care to make certain that the yarn is fed into the yarn channel or slot. Sometimes the yarn may run between the end or beneath a roller adjacent a depending portion of the housing adjacent that end of the roller if the operator fails to properly thread the tensioning device. This results in uneven tension of this yarn and where the tension apparatus, for example, is utilized in connection with a creel for a warp beam, uneven tension is particularly undesirable.

Accordingly, it is an important object of this invention to provide apparatus which insures proper feeding of the yarn into the yarn channel beneath the rows of stacked cylindrical tensioning elements.

SUMMARY OF THE INVENTION

It has been found that proper threading of such a yarn tension apparatus by an operator may be assured by providing a lateral threading passageway originating beneath one end of stacked rows of tensioning cylinders, and providing an inwardly inclined camming surface which terminates beneath one end of the cylinders in order to positively assure that the cylinders will be lifted by the operator moving the yarn through the threading passageway so that it may pass first upwardly and thence downwardly into the yarn passageway or channel.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 2:
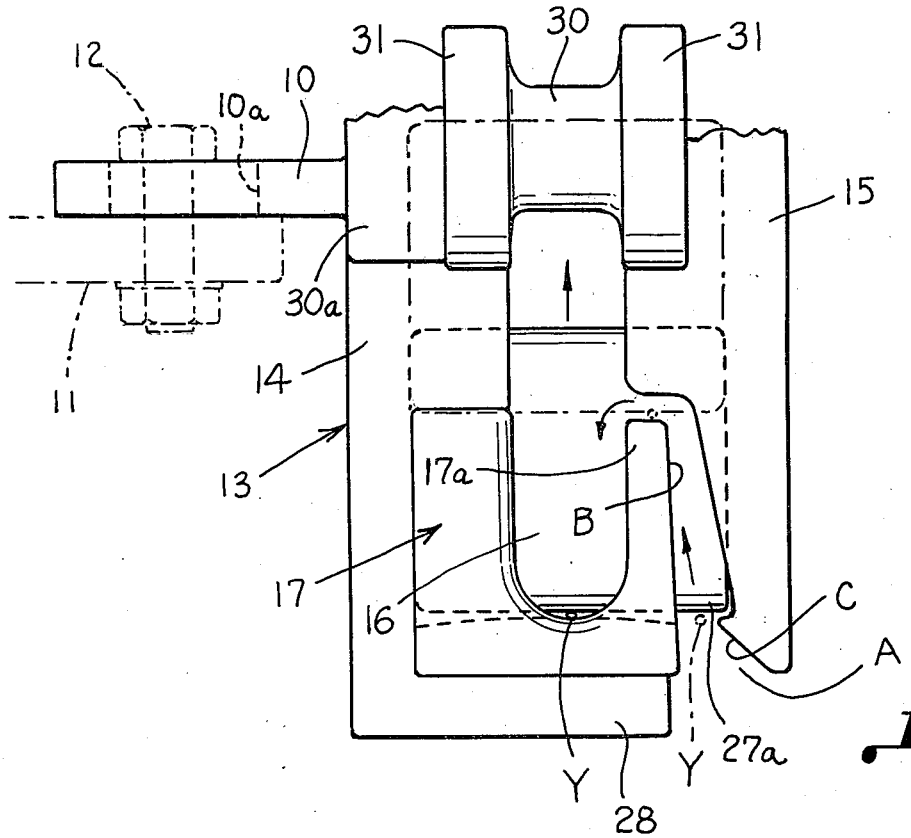
FIG. 2 is an end elevation an enlarged scale with parts broken away, further illustrating the lateral threaded passageway and camming surface for positively positioning the yarn during threading beneath one end of the cylinders.

The drawing illustrates a yarn tensioning device utilizing cylindrical rollers carried for rotation in a plurality of spaced longitudinally aligned upright receptacles in a housing. The receptacles open into a yarn passageway positioning the rollers transversely in rotating engagement with the yarn at spaced positions along the yarn passageway. A lateral threading passageway A opens beneath the rollers adjacent an end thereof and on one side of the yarn passageway for feeding yarn into the yarn passageway. An element carried by the housing defines the yarn passageway and has an upwardly extending yarn guiding surface B extending upwardly forming one side of an opening of the lateral threading passageway. An inwardly extending guiding or camming member C projecting beneath adjacent ends of the rollers is carried by the depending member forming the other side of the opening. Thus, the guiding member insures the proper movement of the yarn for threading into the lateral threading passageway by requiring lifting of the adjacent ends of the rollers. Preferably, the upwardly extending yarn guiding surface is substantially vertical and the element is a ceramic yarn guide defining the yarn passageway.

The yarn tensioning device utilizes a housing broadly designated at 13 which is carried by a rearwardly extending bracket 10 fixed to the housing and being secured as on a machine frame 11 by a suitable fastener 12 which passes through a slot 10*a* in the bracket 10. The housing includes a rear wall 14 and a front wall 15 which has a depending portion extending downwardly therefrom positioning the inwardly extending guiding member or camming surface C. The cylinders 27 are carried in stacked relation in a plurality of longitudinally spaced compartments within the housing 13. The yarn passageway 16 is carried in a ceramic thread guide broadly designated at 17, and is positioned upon a ledge 28 within the lower portion of the housing 13. It will be observed that each of the stacked compartments has openings 28*a* therein to permit the escape of lint, dirt and any foreign objects.

Figure 1:
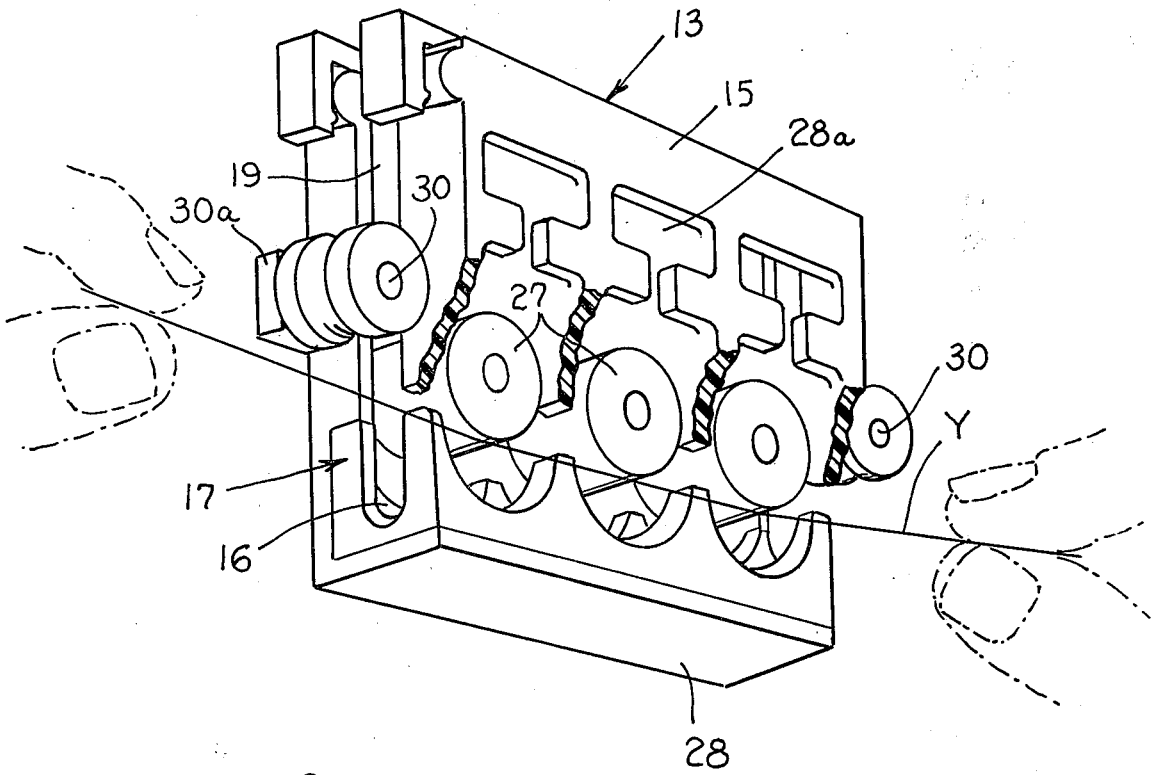
FIG. 1 is a perspective view illustrating an operator manually positioning the yarn within a lateral threaded passageway of a yarn tensioning apparatus constructed in accordance with the present invention.

When the yarn Y is pushed upwardly from the position shown in FIG. 2 to the position shown in FIG. 1, the stacked rows of cylinders 27 are raised adjacent one end thereof to permit passage of the yarn along the surface B and over the top thereof downwardly into the yarn passageway or channel 16 where it is continuously tensioned and from whence it is delivered from the channel as illustrated in FIG. 2. The ends of the yarn on either side of the stacks of rollers are raised within the end slots 19 and passed over the arcuate members 30 which are fixed on either side of the housing by a bracket portion 30*a* extending from one side of the slot 19. The surface 30 is defined on each side by flange portions 31 to further insure proper feeding and delivery of the tensioned yarn.

In FIG. 2, the yarn is illustrated as having been positioned under the cylinder end of the roller illustrated at 27*a* by means of the camming action of the inwardly extending guiding member C. The yarn passes upwardly and over the yarn guiding surface B, which is formed within one of the spaced projections 17*a* which forms a part of the yarn guiding surface B.

It is thus seen that in order to prevent the yarn Y from passing in between the ceramic member 17 and the depending side wall 15 of the housing, the camming surface C assures that the yarn passes beneath the ends of the cylinders. The housing is preferably constructed of plastic and the yarn guiding member 17 is preferably constructed of suitable ceramic material. Thus, expensive yarn breakage and follow-up operations with resulting machine down time is avoided, and even tensioning of the yarn is assured.

While a preferred embodiment of the invention has been described using specific terms, such description is for illustrative purposes only, and it is to be understood that changes and variations may be made without departing from the spirit or scope of the following claims.

What is claimed is:

1. A yarn tensioning device utilizing cylindrical rollers carried for rotation in a plurality of spaced longitudinally aligned upright receptacles in a housing having a depending member, said receptacles opening into a yarn passageway positioning said rollers transversely in rotating engagement with said yarn at spaced positions along said yarn passageway comprising:

a lateral threading passageway having an opening beneath said rollers adjacent an end thereof and on one side of said yarn passageway for feeding yarn into the yarn passageway;

an element carried by said housing defining said yarn passageway and having an upwardly extending yarn guiding surface extending upwardly forming one side of said opening of said lateral threading passageway below said rollers; and an inwardly extending guiding member projecting beneath adjacent ends of said rollers carried by said depending member forming the other side of said opening;

whereby said guiding member insures the proper guiding of yarn for threading into said lateral threading passageway by positively positioning yarn beneath and requiring lifting of said adjacent ends of said rollers.

2. The structure set forth in claim 1 wherein said upwardly extending yarn guiding surface is substantially vertical and said element is a ceramic yarn guide defining said yarn passageway.

* * * * *